US006624118B2

(12) United States Patent
Tang et al.

(10) Patent No.: US 6,624,118 B2
(45) Date of Patent: Sep. 23, 2003

(54) IMAGE TRANSFER ELEMENT

(75) Inventors: Yu Ying Tang, Hadley, MA (US); Douglas Cahill, Belchertown, MA (US); John McCue, Holyoke, MA (US)

(73) Assignee: Rexam Graphics, Inc., South Hadley, MA (US)

( * ) Notice: Subject to any disclaimer, the term of this patent is extended or adjusted under 35 U.S.C. 154(b) by 38 days.

(21) Appl. No.: 09/853,374

(22) Filed: May 11, 2001

(65) Prior Publication Data

US 2003/0026957 A1 Feb. 6, 2003

(51) Int. Cl.[7] ..... B41M 5/035; B41M 5/38
(52) U.S. Cl. ..... 503/227; 428/32.51
(58) Field of Search ..... 428/195, 327, 428/913, 914, 32.51; 503/227

(56) References Cited

U.S. PATENT DOCUMENTS

| | | | | |
|---|---|---|---|---|
| 5,242,739 A | | 9/1993 | Kronzer et al. | 428/200 |
| 5,271,990 A | | 12/1993 | Kronzer et al. | 428/195 |
| 5,302,223 A | | 4/1994 | Hale | 156/230 |
| 5,431,501 A | | 7/1995 | Hale et al. | 400/120.2 |
| 5,501,902 A | | 3/1996 | Kronzer | 428/323 |
| 5,575,877 A | | 11/1996 | Hale et al. | 156/240 |
| 5,798,179 A | | 8/1998 | Kronzer | 428/411.1 |
| 5,948,586 A | | 9/1999 | Hare | 430/138 |
| 6,017,611 A | * | 1/2000 | Cheng et al. | 428/195 |
| 6,083,656 A | | 7/2000 | Hare et al. | 430/138 |
| 6,087,061 A | | 7/2000 | Hare et al. | 430/256 |
| 6,113,725 A | | 9/2000 | Kronzer | 156/230 |
| 6,177,187 B1 | * | 1/2001 | Niemoller et al. | 428/327 |
| 6,200,668 B1 | | 3/2001 | Kronzer | 428/195 |
| 6,361,852 B1 | * | 3/2002 | Gu et al. | 428/195 |

* cited by examiner

*Primary Examiner*—B. Hamilton Hess
(74) *Attorney, Agent, or Firm*—RatnerPrestia

(57) ABSTRACT

An image transfer element that is capable of forming a multicolored image on a variety of substrates using a variety of imaging devices and its method of use are disclosed. The image transfer element comprises a releasable support, and an image-receiving layer over the support. The image-receiving layer comprises (1) a film-forming polymeric binder and (2) particles of a thermoplastic polymer, in which the particles have a particle size of about 1 to about 150 microns and the thermoplastic polymer has a $T_m$ of about 50° C. to about 200° C.

43 Claims, No Drawings

IMAGE TRANSFER ELEMENT

FIELD OF THE INVENTION

This invention relates to an image transfer element for the thermal transfer of images. In particular, this invention relates to an image transfer element that is capable of forming a multicolored image on a variety of substrates using a variety of imaging devices and to its method of use.

BACKGROUND OF THE INVENTION

Although the rapid growth of color printers and copiers has brought convenience and popularity to color imaging on flat and thin substrates such as papers and films, there is still a high demand for personalized color images on substrates that can not be fed through printers or copier. Such substrates include, for example, cloth, wood, leather, ceramic cups, ceramic tiles, glasses, metals, and hard plastics.

These substrates are typically imaged by an image transfer process. In this process, a temporary carrier or image transfer element is imaged with a mirror image of the desired image. The image is then transferred to the desired substrate by the application of heat and/or pressure. These processes have the advantage of not requiring a separate adhesive layer to adhere the image to the substrate.

Image transfer technology can be divided into two major categories: the transfer of sublimable dye molecules and the transfer of colorant-containing layers. Dye-sublimation requires specialty printers and specially designed receiving layers. In addition, dyes that have been specially designed for dye sublimation must be used. These disadvantages limit the use of dye sublimation technology.

The transfer of colorant-containing layers, on the other hand, has wide applications. There is little or no limitation on the imaging technique. The mirror image can be formed on an image-receiving layer by, for example, a laser printer, a wax thermal transfer printer, a phase-change solid ink jet printer, a liquid ink jet printer, a photocopier, or even by hand drawing. The image, along with the image-receiving layer, is transferred to the desired substrate by heat and/or pressure. Good adhesion can be achieved by carefully designing the image-receiving layer to obtain permanent chemical and/or physical bonding between the image-receiving layer and the substrate.

Image transfer has been described, for example, in Kronzer, U.S. Pat. Nos. 6,200,688, 6,113,725, 5,501,902, and 5,271,990. However, there are several disadvantages of these techniques. The major drawback is low durability of the transferred image. For example, when an image-containing image-receiving layer is transferred to a fabric, the image-receiving layer usually sits on the surface of the fabric, resulting in a raised image with poor washability and stress cracks.

Hare, U.S. Pat. Nos. 6,083,656 and 6,087,061, proposes ironing the image after each washing and drying cycle. However, this solution is not only cumbersome, it poses additional problems. Repeated ironing at high temperature usually causes the yellowing of the image transfer layer.

Another major drawback of image transfer to fabric is the undesirable plastic-feel of the transferred image and image transfer layer. This stiffness is caused by a combination of high melting point of the materials in the image transfer layer and the lack of penetration of these materials into the fabric during and after the heat transfer process.

Thus a need exits for an image transfer element that provides an image that has great durability, is easy to apply, has a soft fabric feel, and is compatible with a variety of printers.

SUMMARY OF THE INVENTION

The invention is an image transfer element that provides an image that has great durability, is easy to apply, has a soft fabric feel, and is compatible with a variety of printers. The image transfer element comprises:

a releasable support, and an image-receiving layer over the support; in which:

the image-receiving layer comprises a film-forming polymeric binder and particles of a thermoplastic polymer;

the thermoplastic polymer has a $T_m$ of about 50° C. to about 200° C.;

the particles of the thermoplastic polymer have a particle size of about 1 to about 150 microns; and the film-forming polymeric binder comprises about 5 to about 30 vol % of the image transfer layer, based on the volume of the particles of the thermoplastic polymer present in the layer.

In another embodiment of the invention, the image-receiving layer additionally comprises a barrier layer between the releasable support and the image-receiving layer.

In another aspect, the invention is a method for forming an imaged article using the image transfer element. In yet another aspect, the invention is an imaged article formed by the method of the invention.

DETAILED DESCRIPTION OF THE INVENTION

Image-Receiving Layer

The image-receiving layer is a porous layer upon which an image, typically a multicolored image, can be formed. The image-receiving layer must produce a good image with a variety of imaging devices, especially with inkjet printers, color laser printers, and color copiers. It must have good adhesion to the substrate to which the image is transferred, preferably to a variety of substrates. It must protect the transferred image from damage by, for example, water, light, and mechanical forces. The image transfer layer is a porous layer comprising particles of a thermoplastic polymer. The particles may be from about 1 to about 150 microns in size. They be either dense particles or they may contain internal porosity. The melting point ($T_m$) of the thermoplastic polymer should be at least above the temperatures to which the image transfer element is likely to be exposed during normal storage and handling, typically about 50° C., and less than the thermal transfer temperature, typically about 200° C. Preferably, the melting point of the thermoplastic polymer is greater than about 60° C. and less than about 200° C., more preferably about 60° C. to about 150° C.

The thermoplastic polymer can be, for example, polyethylene, polypropylene, polyvinylacetate, a polyacrylate, an ethylene-vinylacetate copolymer, a vinylchloride-vinylidenechloride copolymer, a polyvinylchloride copolymer, a copolyamide, a copolyester, or a polyurethane. Mixtures of two or more particle sizes and mixtures of particles of two or more thermoplastic polymers can also be used. Because of their soft hand feel, particles of copolyamides, particles of copolyesters, and mixtures thereof are preferred for transfer to fabrics.

The image transfer layer also comprises a film-forming polymeric binder, which provide strength to the image-receiving layer. The binder is typically an amorphous polymer, typically with a glass transition temperature ($T_g$) less than about 40° C., preferably between about −50° C. and about 40° C. Suitable polymers for the binder include, for example, ethylene-vinylacetate copolymers, ethylene-vinylacetate-vinylchloride terpolymers, ethylene-acrylic acid copolymers, ethylene-methacrylic acid copolymers, polyurethanes, polyacrylates, copolyesters, polyvinyl butyrals, polyvinylacetates, and mixtures thereof.

The binder typically comprises about 5 vol % to about 30 vol % of the volume of the particles of the thermoplastic polymer present in the layer (i.e., the volume of the film-forming polymeric binder in the image-receiving layer is about 5% to about 30% of the volume of the particles of the thermoplastic polymer in the image-receiving layer). If the amount of the binder is too low, the image-receiving layer has low mechanical strength. If the amount of the binder is too high, the porosity of the image-receiving layer will be too low. A low porosity layer would produce an inferior image with a liquid inkjet printer. The film-forming polymeric binder and particles of a thermoplastic polymer together typically comprise at least about 75 vol % of the volume of the image receiving layer.

When a flexible image-receiving layer is required, such as for fabric transfer applications, a plasticizer may be present in the image-receiving layer. The plasticizer lowers the melting point and the viscosity of the thermoplastic polymer and increases the melt flow rate of the image-receiving layer into the fabric during the transfer process. The plasticizer also increases the flexibility of the image-receiving layer and gives it a softer feel. Suitable plasticizers include, for example, sulfonamides and sulfonamide derivatives and phthalates and phthalate derivatives. When present, the plasticizer typically is about 2 to about 20 vol % of the volume of the particles of the thermoplastic polymer.

Other conventional additives may be present in the image transfer layer. Dispersing agents can be used to disperse the particles of the thermoplastic polymer in the coating composition. Emulsifying agents or surfactants can be used to emulsify the plasticizer. High melting plastic pigments ($T_m$ greater than about 200° C.) or inorganic pigments, such as silica, can be used as matting agents. Dyes and/or pigments may be added to provide a background color to the image transfer layer. Wetting agents, defoamers, thickeners, ultraviolet absorbers, antioxidants, stabilizers, brighteners, and biocides may also be incorporated in the image-receiving layer. When present, the other additives typically comprise about 5 vol % or less of the volume of the particles of the thermoplastic polymer.

Image Transfer Element

The image transfer element comprises a releasable support, optionally a barrier layer, and the image-receiving layer.

The releasable support functions as a temporary support for the image and the image-receiving layer. It is typically removed and discarded after lamination of the image transfer element to the substrate.

The releasable support should be capable of cold release. That is, after the image transfer element has been laminated to the substrate and cooled to ambient temperature, the releasable support may be easily and cleanly removed from the resulting laminate without resisting removal, leaving portions of the image on the releasable support, or causing imperfections in the transferred image-receiving layer. Thus, the adherence of the releasable support to the rest of the image transfer element must be substantially less than the adherence of the image-receiving layer to the substrate and the barrier layer, if present, to the image-receiving layer.

The releasable support may be any web or sheet material possessing suitable flexibility, dimensional stability and adherence properties. Typically the releasable support is a flexible polymeric film, such as polyethylene terephthalate film, or a foraminous material such as a paper sheet, with at least one release surface. The release surface is formed by treating or coating the surface with a release coating to enhance the desired release characteristics of the surface. Release agents that may be used to prepare release papers and release films include: silicone type release coatings, ultraviolet cured release coatings, electron beam cured release coatings, as well as any other release coating that gives cold release of the releasable support after image transfer.

The surface finish of the transferred image should be similar to the surface of the substrate to provide a natural look to transferred image. This may be done by controlling the outermost surface of the releasable support. If the surface of the releasable support has a rough texture, or contains any other relief pattern, the transferred image will appear matte. If the surface of the releasable support is smooth, the image will be glossy. A matte surface is preferred for transfer to fabric, and a glossy is better suited for transfer to a glossy ceramic tile or a ceramic cup.

An optional barrier layer may be located between the releasable support and the image-receiving layer. The barrier layer is a continuous polymeric layer that provides integrity and durability to the image transfer element. It provides high mechanical strength to the image transfer element, thus increasing the durability for handling and imaging processes. During image transfer, it is transferred to the substrate with the image-receiving layer and thus serves as a protective layer for the transferred image.

The barrier layer comprises a film-forming thermoplastic polymer with a melting point below the thermal transfer temperature, i.e., about 200° C. Suitable polymers are: ethylene-vinylacetate copolymers, ethylene-vinylacetate-vinylchloride terpolymers, ethylene-acrylic acid copolymers, ethylene-methacrylic acid copolymers, polyurethanes, polyacrylates, copolyesters, polyvinyl butyrals, polyvinylacetates, and mixtures thereof.

Other conventional ingredients, such as matting agents, plasticizers, surfactants, antioxidants, ultraviolet absorbers, stabilizers, and thickeners may be incorporated into the barrier layer. The total quantity of the above additives should be lower than 40% of the film-forming polymer.

To prepare the image transfer layer, the ingredients are dispersed in a solvent to form a coating composition. The solvent for the coating composition can be either water, an organic solvent or a mixture of organic solvents, or a mixture of water with one or more organic solvents, provided the solvent does not dissolve the particles of the thermoplastic polymer in the coating mixture. Although the term "solvent" is used, the particles of the thermoplastic polymer must be in suspension, rather than in solution, in the coating composition.

The coating composition coated onto the release surface of the releasable support, or, if a barrier layer is to be present in the image transfer element, onto the barrier layer. Then the solvent is allowed to evaporate. The image transfer layer must not be heated above the melting temperature ($T_m$) of the thermoplastic polymer or the binder during the coating and drying process. The coating weight is determined by the imaging method. For example, to minimize color bleeding for a liquid inkjet printer, high coating weights of 15 to 70 g of dried coating per $m^2$ are necessary. Low coating weight of 2 to 10g/m$^2$ is adequate for other imaging methods such as wax thermal transfer printers, phase change wax inkjet printers, color laser printers, and copiers.

If a barrier layer is present, the ingredients are dispersed in solvent and the resulting coating composition coated onto the release surface of the releasable support. The image transfer layer is coated over the barrier layer. The coating weight of the barrier layer should be 2 to 30g/m$^2$. If the coating weight is lower than 2g/m$^2$, the barrier layer adds little strength to the entire element. If the coating weight is higher than 30g/m$^2$, the barrier layer unnecessarily increases the cost of the image transfer element and, in the case of transfer to fabric, adds to the plastic feel of the transferred image.

Image Formation and Transfer

An mirror image of the desired image is formed on the image-receiving layer. Imaging includes placement of an image on layer by any means, such as, for example, by a liquid inkjet printer, phase-change wax inkjet printer, photocopier, dye sublimation, direct or offset gravure printer, silk-screening, typewriter, laser printer, dot-matrix printer, or hand drawing. The image may be formed be any of the inks, toners, or other compositions typically used in these processes. Typically, the image is formed by a ink jet printer or a photocopier.

The image and image-receiving layer are then laminated to a substrate by the application of heat and pressure. The substrate may be any surface upon which an image is desired. It may be a flexible material or a rigid material. Flexible materials include, for example: polymeric films, such as polyethylene terephthalate film; foraminous materials, such as wood, paper, leather, and woven materials such as silk, canvas, cotton fabric, synthetic fabrics such as polyester fabric and nylon fabric, blends of synthetic fibers and natural fibers such as cotton/polyester blends, and other cloths and fabrics; and metal sheets, such as aluminum sheeting; or as well as flexible composites and laminates thereof. Rigid or semi-rigid materials include, for example: metal sheets or plates, such as metal signs; glass; ceramics; plastics; cardboard; as well as rigid composites and laminates thereof.

Either home appliances or industrial scale heat presses can be used to laminate the image transfer element, provided the device is capable of producing the required heat and pressure.

The required pressure is about that produced by a hand-held iron. For example, if the receiving substrate is fabric, a hand-held iron can be used. If the receiving substrate is a ceramic, such as a flowerpot or a ceramic mug, then a home oven can be used.

The lamination temperature ranges from about 120° C. to about 220° C., depending on the substrate. For example, the transfer temperature to a polyester fabric should be between about 120° C. and about 160° C., in order to avoid damage to the fabric; the transfer temperature to a ceramic tile can be as high as about 160° C. to about 220° C., as long as the coating does not degrade during the transfer process.

After the image-receiving layer has been laminated to the substrate, the releasable support is removed from the resulting laminate leaving an imaged substrate, comprising the support, the image, the image-receiving layer, and, if present in the image transfer element, the barrier layer. The image is reversed by the transfer process and is a right-reading image, i.e., it is no longer a mirror image.

Typically, the releasable support is removed at room temperature with a peel force directed at an angle of 90° or more from the substrate. The removal rate and the force are not critical and preferred values will depend on the nature of the materials. Although the releasable support typically is removed at room temperature, the laminate may be heated slightly to facilitate removal.

Industrial Applicabilty

The thermal transfer element of this invention is capable of forming a multicolored image on a variety of substrates with a variety of imaging devices. It is especially well adapted for use in digital imaging systems. In these systems, an image is captured by a video camera or by a scanning device. Or the image may be a generated by a computer using computed graphics software. The image is stored in a computer, where it may be edited, if desired. The image may be, for example, a photographic image, an artistic image, alphanumeric characters, or a combination thereof. A mirror image of the desired image is formed on the image-receiving layer of the image transfer element using a computer-driven imaging device, such as an inkjet printer or copier.

Thus, the image transfer element of the invention provides significant advantages. The images can be stored in digital form, making it unnecessary for an image applicator to maintain a large inventory of preformed images. Personalized images can be easily created and transferred to, for example, articles of clothing such as T-shirts, hats, sweat shirts, etc. Image generation and transfer can be carried out using readily available equipment, so expensive, specially designed equipment is not required.

The advantageous properties of this invention can be observed by reference to the following examples, which illustrate but do not limit the invention.

EXAMPLES

Glossary

| | |
|---|---|
| AIRFEX ® 728 | Vinylacetate-vinylchloride-ethylene terpolymer emulsion, 52% solids (Air Products, Allentown, PA, USA) |
| AS298-22 | Ethylene-acrylic acid copolymer dispersion, 35% solids (Adhesion System) |
| CoatOSil 1770 | beta-(3,4-Epoxycyclohexyl)ethyltriethoxy-silane (Witco) |
| Griltex 11P1 | Copolyamide powder, average particle size 80 $\mu$m, $T_m$ = 100–110° C. (EMS, Sumter, SC, USA) |
| Griltex PS7200 | Benzyl sulfonamide plasticizer (EMS Chemie, Sumter, SC, USA) |
| Griltex 2P1 | Copolyamide powder, average particle size 80 $\mu$m, $T_m$ = 120–130° C. (EMS, Sumter, SC, USA) |
| Griltex PS8201 | Mixture of surfactants and dispersants (EMS Chemie, Sumter, SC, USA) |
| Kymene 557H | Polyaminoepichlorohydrin resin solution, 12.5% solids (Hercules, Wilmington, DE, USA) |
| Mirox HP-G | Polyacrylate thickener (Stockhausen) |
| Neorez R-9320 | Aqueous polyurethane dispersion, 40% solids (Zeneca Resins, Wilmington, MA) |
| Orgasol 3501 | Copolyamide 6/12 powder, average particle size 10 $\mu$m, internal porosity 74.5 vol %, $T_m$ = 142° C. (Atofina) |
| SURFYNOL ® 440 | Surfactant (Air Products, Allentown, PA, USA) |
| TERGITOL ® 15-S-5 | Polyethylene glycol ether of a mixture of C11 to C15 alcohols with an average of 5 moles of ethylene oxide, surfactant (Union Carbide, Danbury, CT, USA) |
| TRITON ® X-100 | Octoxynol-9 surfactant (Union Carbide, |

-continued

| Glossary | |
|---|---|
| | Danbury, CT, USA) |
| VESTAMELT ® 4680 | Copolyester powder, average particle size 80 $\mu$m; $T_m$ = 105° C. (Creanova, Somerset, NJ, USA) |
| VESTAMELT ® 430 | Copolyester powder, average particle size 80 $\mu$m; $T_m$ = 110° C. (Creanova, Somerset, NJ, USA) |
| ZONYL ® FSO | Fluorosurfactant (E. I. du Pont, Wilmington, DE, USA) |

General Procedure for Image Transfer and Evaluation

The image transfer element was imaged with a Hewlett Packard DESKJET® 970Cxi liquid inkjet printer. The image was allowed to dry for 5 min at ambient temperature. Then it was transferred to a Hanes BEEFY-T® cotton T-shirt with a Proctor-Silex hand held iron (model 14410). The setting of the iron was cotton and the ironing time for an 8.5"×11" (about 20.3 cm×about 27.9 cm) size image was approximately 1.5 min. The release paper was peeled away after the sheet had cooled.

The T-shirt with the transferred image was washed along with other light colored cloth in a KENMORE® washer at a normal setting with TIDE® liquid detergent. The washed T-shirt and other cloth were then dried in a KENMORE® dryer at a normal setting. The T-shirt was inspected after each washing and drying cycle for damages such as cracks in the transferred image, small pieces of the transferred image falling off, color fade, and color bleeding. If any of the above damage was observed, the washing and drying cycle was stopped. Otherwise, the T-shirt was subjected to repeated washing and drying cycles until it fails or until it reached a preset number of cycles.

Example 1

Griltex 1p1 copolyamide powder (28 g) was added to distilled water (58.54 g), and the mixture stirred at high shear for 10 min. AIRFLEX® 728 copolymer emulsion (13.46 g) was added, and mixture stirred at low shear for 5 min. To form the image transfer element, the resulting mixture was coated onto the release surface of a release paper with a #60 Myer rod and dried at 80° C. for 3 min to produce an image-receiving layer with a dry coating weight of 40 g/m$^2$. The release paper is a commercial silicone release paper release paper with a 20 $\mu$m ethylene/vinyl acetate layer extruded onto it (70# cold peel release base from Jencoat, Westfield, Mass.). The image transfer element was evaluated as described in the General Procedures. The results are shown in Table 1.

Example 2

Griltex PS7200 (2.6 g) and TERGITOL® 15-S-5 surfactant (1.3 g) were added to distilled water (62.5 g) and the mixture stirred at high speed for 10 minutes. Griltex 2P1 copolyamide powder (26.10 g) was added and the mixture stirred as high speed for an additional 10 min. AIRFLEX® 728 copolymer emulsion (7.5 g) was added and the resulting mixture stirred at low speed for 5 min.

To form the image transfer element, the resulting mixture was coated with a #70 Myer rod onto the release surface of a 3.5 mil (about 90 micron) thick silicone release paper (Grade 10854 silicone release paper from Rexam Release) and dried at 80° C. for 3 min to produce an image-receiving layer with a dry coating weight of 42 g/m$^2$. This image transfer element was evaluated as described in the General Procedures. The results are shown in Table 1.

Example 3

TERGITOL® 15-S-5 surfactant (1 g) was added to distilled water (63.21 g) and the mixture stirred at high speed for 10 min. VESTAMELT® 4680 (11.54 g), VESTAMELT® 430 (11.54 g), and Orgasol 3501 (2.56 g) were slowly added with stirring and the resulting mixture stirred at high speed for 10 min. The mixing speed was reduced and Neorez R-9320 (9.62 g) was added slowly. The resulting mixture was mixed at high speed for an additional 10 min. The mixing speed was reduced and Kymene 557H (4.10 g) was added slowly. The resulting mixture was mixed at high speed for an additional 10 min.

To form the image transfer element, the resulting mixture was coated with a #60 Myer rod onto the release surface of the release paper used in Example 2 and dried at 80° C. for 3 min to produce an image-receiving layer with a dry coating weight of 36 g/m$^2$. The image transfer element was evaluated as described in the General Procedures. The results are shown in Table 1.

Example 4

TRITON® X-100 surfactant (0.34 g) was added to distilled water (59.34 g) and the mixture stirred for 2 min. Griltex 2P1 copolyamide powder (33.95 g) was added, and resulting mixture stirred at high speed for 10 min. The mixing speed was reduced and AIRFLEX® 728 (5.17 g) terpolymer emulsion added and the resulting mixture stirred for 5 min. Mirox HP-G thickener (1.20 g) was added and mixing continued for 10 min.

To form the image transfer element, the resulting mixture was coated with a #70 Myer rod onto the release surface of the release paper used in Example 1 and dried at 80° C. for 3 min to produce an image-receiving layer with a dry coating weight of 42 g/m$^2$. The image transfer element was evaluated as described in the General Procedures. The results are shown in Table 1.

Example 5

This example illustrates preparation and evaluation of an image transfer element comprising a barrier layer.

Orgasol 3501 (1.35 g) was added slowly to a mixture of distilled water (11.92 g) and iso-propyl alcohol (5.00 g) and the resulting mixture stirred at high speed for 10 min. The mixing speed was reduced. AS298-22 (81.43 g) copolymer dispersion and ZONYL® FSO surfactant (0.30 g) were added, and the resulting mixture stirred for 10 min. The resulting mixture was coated with a #18 Myer rod onto the release surface of a 4.5 mil (about 115 microns) thick silicone release paper (Grade 11257 silicone release paper from Rexam Graphics) and dried at 185° C. for 1.5 min to produce a barrier layer with a dry coating weight of 8 g/m$^2$.

Griltex PS8201 (1.8 g) was dissolved in distilled water (61.21 g) and the resulting mixture stirred at high speed for 15 min. Griltex PS7200 (1.8 g) was added and the resulting mixture stirred at high speed for 5 min. Griltex 11p1 (18 g) was added and the resulting mixture stirred at high speed for 5 min. Orgasol 3501 (3.6 g) was added and the resulting mixture stirred at high speed for 5 min. The mixing speed was lowered and AS298-22 (13.29 g) added and the resulting mixture stirred for 5 min. ZONYL® FSO fluorosurfactant (0.20 g) was added and the resulting mixture stirred for 5 min.

To produce the image transfer element, the resulting mixture was coated with a #70 Myer rod over the barrier layer and dried at 80° C. for 3 min to produce an image-receiving layer with a dry coating weight of 42 g/m$^2$. The resulting image transfer element, consisting of the silicone release sheet, the barrier layer, and the image-receiving layer, was then imaged with the following: Hewlett Packard DESKJET® 970 Cxi liquid inkjet printer; Tektronix Phaser 860DP phase change wax inkjet printer; Tektronix Phaser 750P color laser printer; and Konica 4355 copier. The resulting images were transferred and evaluated as described in the General Procedures. The results are shown in Table 1.

TABLE 1

Performance evaluation of the fabric transfer samples

| Sample | Imaging methods | Printer | Image quality | Testing cycles | Comment |
|---|---|---|---|---|---|
| Ex1 | Liquid inkjet | HP970Cxi | Good | 10 | Slight color fading |
| Ex2 | | HP970Cxi | Very good | 15 | Fine cracks in black |
| Ex3 | | HP970Cxi | Very good | 12 | Color fading |
| Ex4 | | HP970Cxi | Very good | >25 | |
| Ex5 | | HP970Cxi | Very good | >25 | |
| Ex5 | Wax inkjet | Tektronix Phaser 860D | Very good | >25 | |
| Ex5 | Color laser | Tektronix Phaser 750 | Good | >25 | |
| Ex5 | Copier | Konica 4355 | Good | >25 | |

Example 6

This example illustrates transfer of an image to a ceramic substrate.

SURFYNOL® 440 (1.32 g) was added to distilled water (55.19 g) and the mixture stirred at high speed for 5 min. VESTAMELT® 4680 (23.77 g) and Orgasol 3501 (3.96 g) were slowly added with stirring and the resulting mixture stirred at high speed for 10 min. The mixing speed was reduced, and CoatOSil (0.66 g) and AS298-22 (15.09 g) were added slowly. The resulting mixture was mixed at low speed for an additional 10 min.

The resulting solution was coated on a glossy ultraviolet cured release paper with a #60 Myer rod and dried at 85° C. for 3 min to produce an image transfer layer with a dry coating weight of 35 g/m$^2$. The resulting image transfer element was imaged with a Hewlett Packard DESKJET® 970Cxi liquid inkjet printer. The image was allowed to day for 5 min at ambient temperature and then transferred to a ceramic tile in an oven at 176° C. and 5 psi pressure for 10 min. The tile with transferred image was then soaked in water for 2 hr. No color bleeding of the image was observed. The sample was then taken out and pat dried.

To test the adhesion of the transferred image to the tile, a 2.5 cm wide piece of SCOTCH® 610 pressure sensitive tape was applied over a corner of the image and pressed hard to produce firm adherence. When the tape was removed, no peeling or removal of the image was observed. This test was repeated with the other three corner of the image and also with an X-cut in the middle of the transferred image. No peel or damage of the image was observed.

Although the invention has been particularly described with reference to certain embodiments, those skilled in the art will appreciate that various modifications may be made without departing from the spirit and scope of the invention. Having described the invention, we now claim the following and their equivalents.

What is claimed is:

1. An image transfer element comprising:

a releasable support, and an image-receiving layer over the support;

in which:

the image-receiving layer comprises a film-forming polymeric binder and particles of a thermoplastic polymer;

the thermoplastic polymer has a Tm of about 50° C. to about 200° C.;

the particles of the thermoplastic polymer have a particle size of 80 microns to about 150 microns; and the film-forming polymeric binder comprises about 5 to about 30 vol % of the image transfer layer, based on the volume of the particles of the thermoplastic polymer present in the layer.

2. The image transfer element of claim 1 in which the $T_g$ of the film-forming polymeric binder is between about −50° C. and about 40° C.

3. The image transfer element of claim 2 in which the $T_m$ of the thermoplastic polymer is from about 60° C. to about 150° C.

4. The image transfer element of claim 3 in which the releasable support comprises a release surface.

5. The image transfer element of claim 1 in which the $T_m$ of the thermoplastic polymer is from about 60° C. to about 150° C.

6. The image transfer element of claim 1 in which the thermoplastic polymer is polyethylene, polypropylene, polyvinylacetate, a polyacrylate, an ethylene-vinylacetate copolymer, a vinylchloride-vinylidenechloride copolymer, a polyvinylchloride copolymer, a copolyamide, a copolyester, a polyurethane, or a mixture thereof.

7. The image transfer element of claim 1 in which the polymeric binder is selected from the group consisting of ethylene-vinylacetate copolymers, ethylene-vinylacetate-vinylchloride terpolymers, ethylene-acrylic acid copolymers, ethylene-methacrylic acid copolymers, polyurethanes, polyacrylates, copolyesters, polyvinyl butyrals, polyvinylacetates, and mixtures thereof.

8. The image transfer element of claim 1 in which the image-receiving layer additionally comprises a plasticizer.

9. The image transfer element of claim 8 in which the $T_g$ of the film-forming polymeric binder is between about −50° C. and about 40° C.

10. The image transfer element of claim 9 in which the $T_m$ of the thermoplastic polymer is from about 60° C. to about 150° C.

11. The image transfer element of claim 10 in which the $T_m$ of the thermoplastic polymer is from about 60° C. to about 150° C.

12. The image transfer element of claim 1 in which the image-receiving layer additionally comprises one or more additives selected from the group consisting of dispersing agents, surfactants, matting agent, dyes, pigments, wetting agents, defoamers, thickeners, ultraviolet absorbers, antioxidants, stabilizers, brighteners, and biocides.

13. The image transfer element of claim 1 in which the element additionally comprise a barrier layer between the releasable support and the image-receiving layer in which the barrier layer comprises a film-forming thermoplastic polymer with a $T_m$ below about 200° C.

14. The image receiving element of claim 13 in which the film-forming thermoplastic polymer with a $T_m$ below about 200° C. is selected from the group consisting of ethylene-vinylacetate copolymers, ethylene-vinylacetate-vinylchloride terpolymers, ethylene-acrylic acid copolymers, ethylene-methacrylic acid copolymers, polyurethanes, polyacrylates, copolyesters, polyvinyl butyrals, polyvinylacetates, and mixtures thereof.

15. The image transfer element of claim 13 in which the $T_g$ of the film-forming polymeric binder is between about −50° C. and about 40° C.

16. The image transfer element of claim 15 in which the $T_m$ of the thermoplastic polymer is from about 60° C. to about 150° C.

17. The image transfer element of claim 16 in which the releasable support comprises a release surface.

18. The image transfer element of claim 13 in which the $T_m$ of the thermoplastic polymer is from about 60° C. to about 150° C.

19. The image transfer element of claim 13 in which the image-receiving layer additionally comprises a plasticizer.

20. The image transfer element of claim 1 in which the film-forming polymeric binder and particles of a thermoplastic polymer together comprise at least about 75 vol % of the image-receiving layer.

21. The image transfer element of claim 1 in which the image-receiving layer comprises a first surface and a second surface that opposes the first surface, the first surface of the image-receiving layer faces the releasable support, and second surface of the image-receiving layer comprises an image.

22. The image transfer element of claim 21 in which the element additionally comprises a substrate over the image and the second surface of the image-receiving layer.

23. The image transfer element of claim 22 in which the $T_g$ of the film-forming polymeric binder is between about −50° C. and about 40° C., and the $T_m$ of the thermoplastic polymer is from about 60° C. to about 150° C.

24. The image transfer element of claim 23 in which the film-forming polymeric binder and particles of a thermoplastic polymer together comprise at least about 75 vol % of the image-receiving layer.

25. The image transfer element of claim 24 in which the substrate is selected from the group consisting of polymeric films, fabrics, metal sheet, glass, ceramics, plastics, and composites and laminates thereof.

26. The image transfer element of claim 1 in which the film-forming polymeric binder is an ethylene vinyl acetate copolymer and the thermoplastic polymer is a copolyamide.

27. A method of forming an image on a substrate, the method comprising the steps of:

(A) forming an image on a surface of an image-receiving layer of an image transfer element and producing an imaged surface, the image transfer element comprising:
a releasable support, and
the image-receiving layer over the support;

in which:
the image-receiving layer comprises a film-forming polymeric binder and
particles of a thermoplastic polymer;
the thermoplastic polymer has a Tm of about 50° C. to about 200° C.;
the particles of the thermoplastic polymer have a particle size of 80 microns to about 150 microns; and
the film-forming polymeric binder comprises about 5 to about 30 vol % of the image transfer layer, based on the volume of the particles of the thermoplastic polymer present in the layer;

(B) laminating the image transfer element to the substrate;

in which:
the imaged surface of the image-receiving layer is laminated to a surface of the substrate, and
laminating is carried out at a temperature above the Tm of the thermoplastic polymer; and (C) removing the releasable support.

28. The method of claim 27 in which the $T_g$ of the film-forming polymeric binder is between about −50° C. and about 40° C. and the $T_m$ of the thermoplastic polymer is from about 60° C. to about 150° C.

29. The method of claim 27 in which the laminating is carried out at a temperature between about 120° C. and about 220° C.

30. The method of claim 27 in which the thermoplastic polymer is polyethylene, polypropylene, polyvinylacetate, a polyacrylate, an ethylene-vinylacetate copolymer, a vinylchloride-vinylidenechloride copolymer, a polyvinylchloride copolymer, a copolyamide, a copolyester, a polyurethane, or a mixture thereof.

31. The method of claim 27 in which the polymeric binder is selected from the group consisting of ethylene-vinylacetate copolymers, ethylene-vinylacetate-vinylchloride terpolymers, ethylene-acrylic acid copolymers, ethylene-methacrylic acid copolymers, polyurethanes, polyacrylates, copolyesters, polyvinyl butyrals, polyvinylacetates, and mixtures thereof.

32. The method of claim 27 in which the element additionally comprise a barrier layer between the releasable support and the image-receiving layer in which the barrier layer comprises a film-forming thermoplastic polymer with a $T_m$ below about 200° C.

33. The method of claim 32 in which the film-forming thermoplastic polymer with a $T_m$ below about 200° C. is selected from the group consisting of ethylene-vinylacetate copolymers, ethylene-vinylacetate-vinylchloride terpolymers, ethylene-acrylic acid copolymers, ethylene-methacrylic acid copolymers, polyurethanes, polyacrylates, copolyesters, polyvinyl butyrals, polyvinylacetates, and mixtures thereof.

34. An imaged substrate prepared by the method comprising the steps of:

(A) forming an image on a surface of an image-receiving layer of an image transfer element and producing an imaged surface, the image transfer element comprising:
a releasable support, and
the image-receiving layer over the support;

in which:
the image-receiving layer comprises a film-forming polymeric binder and particles of a thermoplastic polymer;
the thermoplastic polymer has a Tm of about 50° C. to about 200° C.;

the particles of the thermoplastic polymer have a particle size of 80 microns to about 150 microns; and
the film-forming polymeric binder comprises about 5 to about 30 vol % of the image transfer layer, based on the volume of the particles of the thermoplastic polymer present in the layer;

(B) laminating the image transfer element to the substrate;

in which:
the imaged surface of the image-receiving layer is laminated to a surface of the substrate, and
laminating is carried out at a temperature above the Tm of the thermoplastic polymer; and (C) removing the releasable support.

35. The imaged substrate of claim 34 in which the $T_g$ of the film-forming polymeric binder is between about −50° C. and about 40° C. and the $T_m$ of the thermoplastic polymer is from about 60° C. to about 150° C.

36. The imaged substrate of claim 34 in which the laminating is carried out at a temperature between about 120° C. and about 220° C.

37. The imaged substrate of claim 34 in which the substrate is selected from the group consisting of polymeric films, fabrics, metal sheet, glass, ceramics, plastics, and composites and laminates thereof.

38. The imaged substrate of claim 34 in which the thermoplastic polymer is polyethylene, polypropylene, polyvinylacetate, a polyacrylate, an ethylene-vinylacetate copolymer, a vinylchloride-vinylidenechloride copolymer, a polyvinylchloride copolymer, a copolyamide, a copolyester, a polyurethane, or a mixture thereof.

39. The imaged substrate of claim 34 in which the polymeric binder is selected from the group consisting of ethylene-vinylacetate copolymers, ethylene-vinylacetate-vinylchloride terpolymers, ethylene-acrylic acid copolymers, ethylene-methacrylic acid copolymers, polyurethanes, polyacrylates, copolyesters, polyvinyl butyrals, polyvinylacetates, and mixtures thereof.

40. The imaged substrate of claim 34 in which the element additionally comprise a barrier layer between the releasable support and the image-receiving layer in which the barrier layer comprises a film-forming thermoplastic polymer with a $T_m$ below about 200° C.

41. The imaged substrate of claim 40 in which the film-forming thermoplastic polymer with a $T_m$ below about 200° C. is selected from the group consisting of ethylene-vinylacetate copolymers, ethylene-vinylacetate-vinylchloride terpolymers, ethylene-acrylic acid copolymers, ethylene-methacrylic acid copolymers, polyurethanes, polyacrylates, copolyesters, polyvinyl butyrals, polyvinylacetates, and mixtures thereof.

42. An image transfer element comprising:

a releasable support, and an image-receiving layer over the support;

in which:

the image-receiving layer comprises a film-forming polymeric binder and particles of a first thermoplastic polymer and a second thermoplastic polymer;

each of the first and second thermoplastic polymers has a Tm of about 50° C. to about 200° C.;

the particles of the first thermoplastic polymer have a particle size of 80 microns to about 150 microns, and the particles of the second thermoplastic polymer have a particle size of about 10 microns, wherein a weight average particle size of the first and second thermoplastic polymers taken together is greater than about 68; and the film-forming polymeric binder comprises about 5 to about 30 vol % of the image transfer layer, based on the volume of the particles of the thermoplastic polymer present in the layer.

43. A method of forming an image on a substrate, the method comprising the steps of:

(A) forming an image on a surface of an image-receiving layer of an image transfer element and producing an imaged surface, the image transfer element comprising:

a releasable support, and the image-receiving layer over the support;

in which:

the image-receiving layer comprises a film-forming polymeric binder and particles of a first thermoplastic polymer and a second thermoplastic polymer;

each of the first and second thermoplastic polymers has a Tm of about 50° C. to about 200° C.;

the particles of the first thermoplastic polymer have a particle size of 80 microns to about 150 microns, and the particles of the second thermoplastic polymer have a particle size of 10 microns, wherein a weight average particle size of the first and second thermoplastic polymers taken together is greater than about 68; and the film-forming polymeric binder comprises about 5 to about 30 vol % of the image transfer layer, based on the volume of the particles of the thermoplastic polymer present in the layer;

(B) laminating the image transfer element to the substrate;

in which:

the imaged surface of the image-receiving layer is laminated to a surface of the substrate, and laminating is carried out at a temperature above the Tm of the thermoplastic polymer; and (C) removing the releasable support.

* * * * *